US010456822B2

(12) United States Patent
Zhu et al.

(10) Patent No.: US 10,456,822 B2
(45) Date of Patent: Oct. 29, 2019

(54) TANDEM WATER SPOT COOLING DEVICE FOR TOP DIE

(71) Applicant: CITIC Dicastal CO., LTD, Qinhuangdao (CN)

(72) Inventors: Lin Zhu, Qinhuangdao (CN); Changhai Li, Qinhuangdao (CN); Hongbiao Li, Qinhuangdao (CN); Yong Li, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 385 days.

(21) Appl. No.: 15/483,037

(22) Filed: Apr. 10, 2017

(65) Prior Publication Data

US 2017/0291212 A1 Oct. 12, 2017

(30) Foreign Application Priority Data

Apr. 8, 2016 (CN) ..... 2016 1 0216598

(51) Int. Cl.

| | |
|---|---|
| ***B22C 9/06*** | (2006.01) |
| ***B22D 17/22*** | (2006.01) |
| ***B22D 18/04*** | (2006.01) |
| ***B21D 37/16*** | (2006.01) |
| ***B21D 22/02*** | (2006.01) |
| ***B21D 53/26*** | (2006.01) |

(52) U.S. Cl.

CPC ..... *B21D 37/16* (2013.01); *B21D 22/02* (2013.01); *B21D 53/26* (2013.01); *B22C 9/065* (2013.01); *B22D 17/2218* (2013.01); *B22D 18/04* (2013.01)

(58) Field of Classification Search

CPC ..... B22C 9/065; B22C 9/28; B22D 17/2218; B22D 18/04

See application file for complete search history.

(56) References Cited

U.S. PATENT DOCUMENTS 5,314,001 A * 5/1994 Hidaka ..... B22C 9/28 164/119

FOREIGN PATENT DOCUMENTS

CN 105562659 A * 5/2016

* cited by examiner

*Primary Examiner* — Kevin E Yoon

(74) *Attorney, Agent, or Firm* — Maier & Maier, PLLC

(57) ABSTRACT

A tandem water spot cooling device for a top die. The device includes a spot cooling device main body, a lower sealing plate, an outer-ring circular track, an inner-ring serpentine passage, outer-ring flow dividing baffles, inner-ring flow dividing baffles, outer-ring through holes, inner-ring through holes, bolt hole reservation positions, stripper rod reservation positions, and water inlet and outlet connection through holes.

6 Claims, 4 Drawing Sheets

TANDEM WATER SPOT COOLING DEVICE FOR TOP DIE

TECHNICAL FIELD

The present invention relates to the field of automobile parts, and in particular to a tandem water spot cooling device for a top die for wheel casting.

BACKGROUND ART

With the gradual development of standards for aluminum wheels in the automobile industry, the development and popularization of water-cooled dies have already become a trend for aluminum wheel manufacturing enterprises. However, various problems are encountered during the research and popularization of the water-cooled dies. FIG. 1 shows a structural schematic diagram of a water-cooled die in the prior art in the art. The cooling structure has the disadvantage that water cooling for a top die flange fails in really powerful cooling for a center flange.

An air-cooled die cooling solution for effectively cooling to the center of the flange is also provided in the prior art, as shown in FIG. 2. As can be seen from FIG. 1 and FIG. 2, due to the use of blind hole spot cooling for the air-cooled die, targeted cooling for castings can be implemented, whereas only an external layout can be made for center cooling for the water-cooled die due to space limitation, thus failing in effective cooling for a region really needing to be cooled.

Hence, this problem must be solved before the popularization of the water-cooled die in the wheel industry.

SUMMARY OF THE INVENTION

Accordingly, the present invention aims at providing a water-cooled die to powerfully cool a center flange and overcome the limitations of a space layout to the water-cooled die.

In one aspect of the present invention, provided is a tandem water spot cooling device for a top die, comprising a spot cooling device main body (1), a lower sealing plate (2), an outer-ring circular track (3), an inner-ring serpentine passage (4), outer-ring flow dividing baffles (5), inner-ring flow dividing baffles (6), outer-ring through holes (7), inner-ring through holes (8), bolt hole reservation positions (9), stripper rod reservation positions (10), and water inlet and outlet connection through holes (11), wherein the spot cooling device main body (1) is a steel disc, and comprises the outer-ring circular track (3) and the inner-ring serpentine passage (4) which are connected together end to end, respectively; the outer-ring through holes (7) and the outer-ring flow dividing baffles (5) are provided in the outer-ring circular track (3), and the outer-ring through holes (7) are connected to cooling holes in a top die of a die; the inner-ring through holes (8) and the inner-ring flow dividing baffles (6) are provided in the inner-ring serpentine passage (4), and the inner-ring through holes (8) are connected to the cooling holes in the top die of the die; the spot cooling device main body (1) is provided with the stripper rod reservation positions (10) at an inner side of the inner-ring serpentine passage (4); the spot cooling device main body (1) is provided with the bolt hole reservation positions (9); the lower sealing plate (2) is disposed below the spot cooling device main body (1), and the spot cooling device main body (1) and the lower sealing plate (2) are configured to encircle the outer-ring circular track (3) and the inner-ring serpentine passage (4) to form closed ducts; and the outer-ring circular track (3) and the inner-ring serpentine passage (4) of the tandem water spot cooling device for the top die are connected to the water inlet and outlet connection through holes (11), respectively.

In a preferred aspect of the present invention, the outer-ring circular track (3) and the inner-ring serpentine passage (4) are disposed corresponding to spot cooling holes in the top die.

In a preferred aspect of the present invention, the outer-ring flow dividing baffles (5) and the inner-ring flow dividing baffles (6) are fixed to the spot cooling device main body (1) by way of spot welding, located corresponding to the cooling holes in the top die of the die, and oriented towards the same center of circle.

In a preferred aspect of the present invention, the outer-ring flow dividing baffles (5) and the inner-ring flow dividing baffles (6) are made of 304 stainless steel with thickness of 1-2 mm.

In a preferred aspect of the present invention, the spot cooling device main body (1) is bonded with the lower sealing plate (2) by means of a high temperature resistant sealant.

In a preferred aspect of the present invention, the outer-ring circular track (3) and the inner-ring serpentine passage (4) have diameters with a range of 10-16 mm.

In other aspects of the present invention, the following technical solution is further provided: a tandem water spot cooling device for a top die comprises a spot cooling device main body 1, a lower sealing plate 2, flow dividing baffles 5, and flow dividing baffles 6. The spot cooling device main body 1 is designed with an outer-ring circular track 3 and an inner-ring serpentine passage 4 which are corresponding to spot cooling holes in the top die. The formation of the serpentine passage at the inner ring is mainly intended to reserve enough space for bolt holes 9 and stripper rod holes 10. Outer-ring through holes 7 and inner-ring through holes 8, which are corresponding to the spot cooling holes in the top die, are machined in the lower sealing plate 2. The outer-ring flow dividing baffles 5 and the inner-ring flow dividing baffles 6 are fixed to the spot cooling device main body 1 by way of spot welding, and the plurality of flow dividing baffles must be oriented to the same center of circle. The spot cooling device main body 1 is bonded with the lower sealing plate 2 by means of a high temperature resistant sealant. Water inlets and outlets are configured as shown in FIG. 6 to FIG. 8.

The tandem water spot cooling device for the top die provided by the present invention has the following advantages that space limitation is avoided by using the serpentine passage, thereby allowing the cooling layout for the region really needing to be cooled; all cooling layout positions are consistent with those of the air-cooled die, leading to reduction of difficulty in secondary process development; according to the least resistance principle of fluid flow, the flow dividing baffles are adopted to achieve flow division of spot cooling with the advantages of simple structure, easy maintenance and cost reduction; and because of achievable cooling directed to the region needing to be cooled, the quality and production efficiency of castings can be improved favorably.

BRIEF DESCRIPTION OF THE DRAWINGS

The implementation of the present invention will be described below in detail in conjunction with accompanying drawings, in which.

Figure 1:
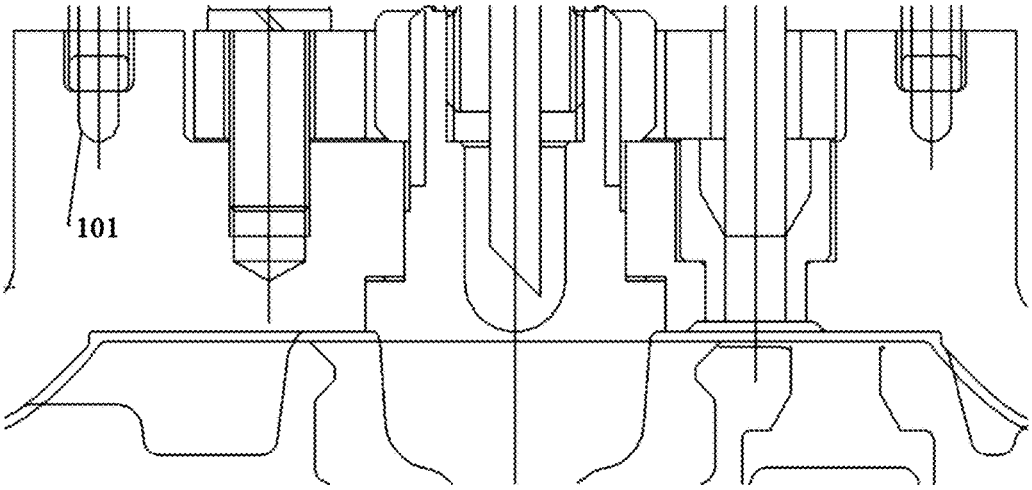
Fig.1 PRIOR ART
FIG. 1 is a structural schematic diagram of a water cooling device for a die in the prior art.
Figure 2:
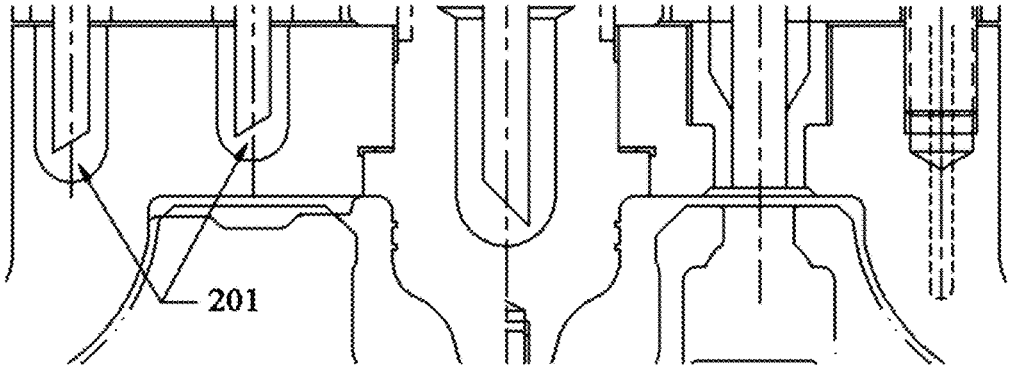
Fig.2 PRIOR ART
FIG. 2 is a structural schematic diagram of an air cooling device for a die in the prior art.
Figure 3:
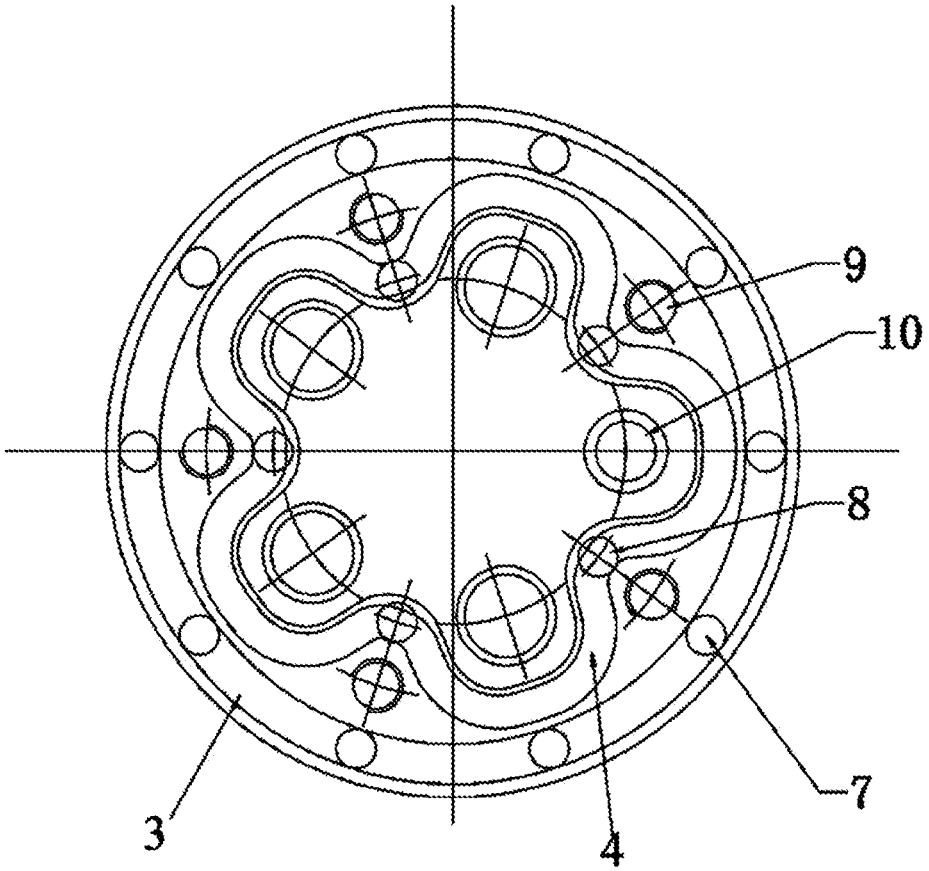
FIG. 3 is a top view of a tandem water spot cooling device for a top die of the present invention.

In the drawings, 101—Cooling pipe of the water cooling device for a die in the prior art; 201—Cooling pipe of the air cooling device for a die in the prior art; 1—Spot cooling device main body; 2—Lower sealing plate; 3—Outer-ring circular track; 4—Inner-ring serpentine passage; 5—Outer-ring flow dividing baffle; 6—Inner-ring flow dividing baffle; 7—Outer-ring through hole; 8—Inner-ring through hole; 9—Bolt hole reservation position; 10—Tripper rod reservation position, and 11—Water inlet and outlet connection through holes.

DETAILED DESCRIPTION OF THE INVENTION

Embodiment 1

Figure 4:
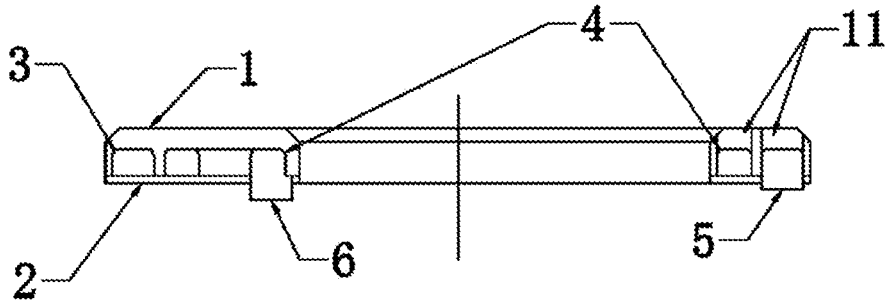
FIG. 4 is a side view of a tandem water spot cooling device for a top die of the present invention.
Figure 5:
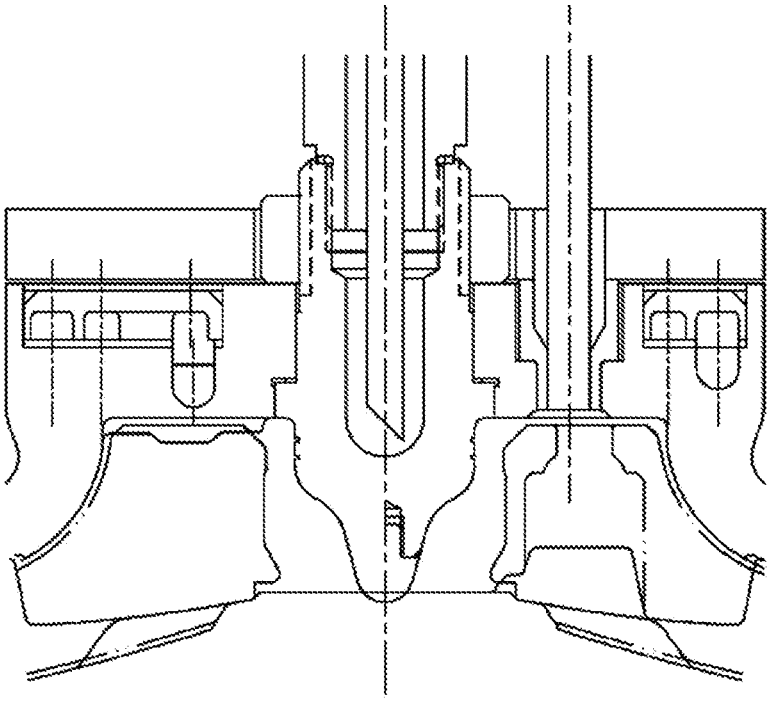
FIG. 5 is an assembly diagram of a tandem water spot cooling device for a top die of the present invention.
Figure 6:
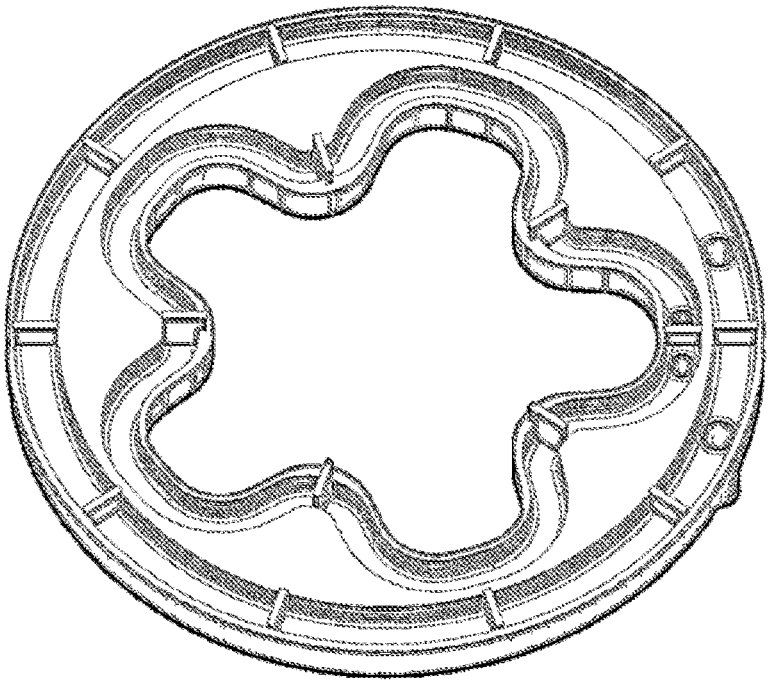
FIG. 6 is an upward space diagram of a tandem water spot cooling device for a top die of the present invention.
Figure 7:
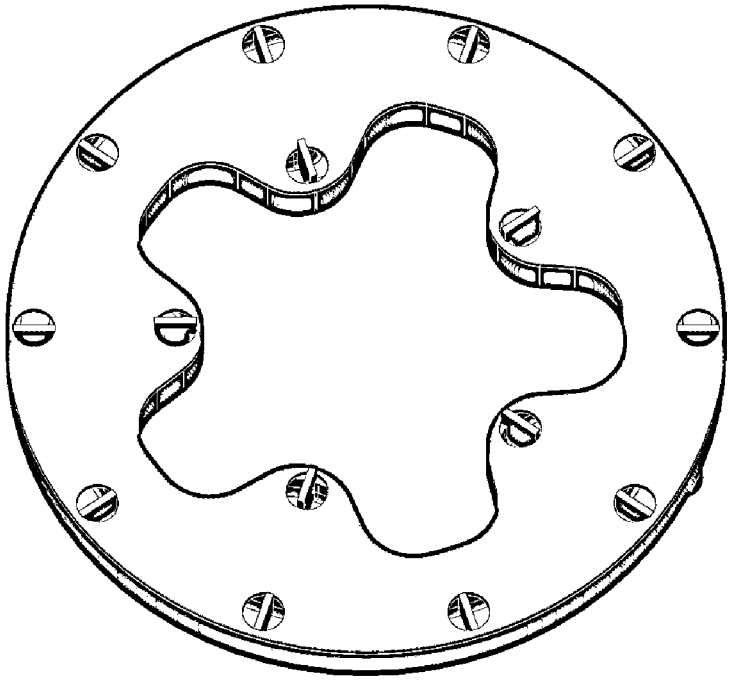
FIG. 7 is a downward space diagram of a tandem water spot cooling device for a top die of the present invention.
Figure 8:
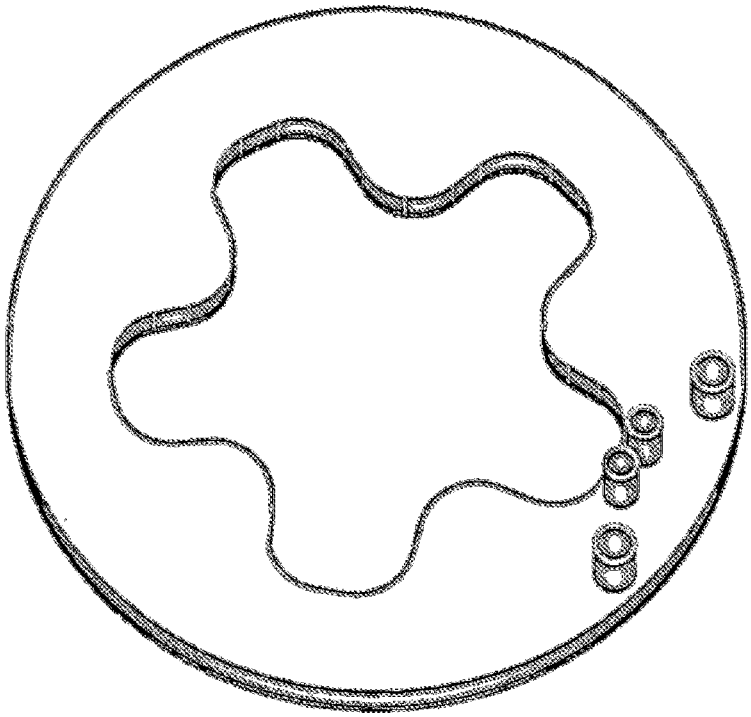
FIG. 8 is a downward space diagram of a tandem water spot cooling device for a top die of the present invention.

A tandem water spot cooling device for a top die provided by the present invention comprises a spot cooling device main body 1, a lower sealing plate 2, outer-ring flow dividing baffles 5, and inner-ring flow dividing baffles 6. Firstly, the satisfied spot cooling device main body 1 is machined according to dimensions of a drawing, during which an accurate position of an inner-ring serpentine passage 4 should be especially guaranteed, and equivalent diameters of an outer-ring circular track 3 and the inner-ring serpentine passage 4 should be guaranteed within a range of 10-16 mm. In addition, four through holes 11 for mounting water inlet and outlet connections are further machined. Secondly, the lower sealing plate 2 is machined according to requirements. It must be ensured that outer-ring through holes 7 and inner-ring through holes 8 in the lower sealing plate 2 accurately correspond to spot cooling holes in a top die flange. Afterwards, the outer-ring flow dividing baffles 5 and the inner-ring flow dividing baffles 6 of corresponding dimensions are machined according to the drawings. The flow dividing baffles are made of 304 stainless steel of which the thickness is controlled within a range of 1-2 mm. Finally, the spot cooling device main body 1 is bonded to the lower sealing plate 2 by using a high temperature resistant sealant to form a non-sealed integrated body, thus realizing control on total flow of spot cooling. Because the flow resistance between the matching surfaces of the spot cooling device main body 1 and the lower sealing plate 2 is certainly greater than the flow resistance in the spot cooling holes according to the least resistance principle of fluid flow, a fluid will certainly flow away via the spot cooling holes. Afterwards, the outer-ring flow dividing baffles 5 and the inner-ring flow dividing baffles 6 are mounted in corresponding holes and fixed by way of spot welding. After the above work is finished, the whole device can be fitted on the top die according to the schematic assembly diagram as shown in FIG. 4 with 3D effect drawings as shown in FIG. 6 to FIG. 8.

The tandem water spot cooling device for the top die manufactured according to this embodiment achieves uniform and powerful cooling for the top die and overcomes the defects of various water spot welding devices in the prior art. In particular, cooling for the flange part is well improved.

The tandem water spot cooling device for the top die provided by the present invention is not limited to the summary of the present invention and the contents described in the detailed description of the embodiments. Other design patterns obtained according to the teaching of the summary of the present invention shall all fall within the protection scope of the present invention.

The invention claimed is:

1. A tandem water spot cooling device for a top die, comprising:

a spot cooling device main body, a lower sealing plate, an outer-ring circular track, an inner-ring serpentine passage, outer-ring flow dividing baffles, inner-ring flow dividing baffles, outer-ring through holes, inner-ring through holes, bolt hole reservation positions, stripper rod reservation positions, and water inlet and outlet connection through holes, wherein the spot cooling device main body is a steel disc, and comprises the outer-ring circular track and the inner-ring serpentine passage which are connected together end to end, respectively; the outer-ring through holes and the outer-ring flow dividing baffles are provided in the outer-ring circular track, and the outer-ring through holes are connected to cooling holes in a top die of a die; the inner-ring through holes and the inner-ring flow dividing baffles are provided in the inner-ring serpentine passage, and the inner-ring through holes are connected to the cooling holes in the top die of the die; the spot cooling device main body is provided with the stripper rod reservation positions at an inner side of the inner-ring serpentine passage; the spot cooling device main body is provided with the bolt hole reservation positions; the lower sealing plate is disposed below the spot cooling device main body, and the spot cooling device main body and the lower sealing plate are configured to encircle the outer-ring circular track and the inner-ring serpentine passage to form closed ducts; and the outer-ring circular track and the inner-ring serpentine passage of the tandem water spot cooling device for the top die are connected to the water inlet and outlet connection through holes, respectively.

2. The tandem water spot cooling device for the top die according to claim 1, wherein the outer-ring circular track and the inner-ring serpentine passage are disposed corresponding to spot cooling holes in the top die.

3. The tandem water spot cooling device for the top die according to claim 1, wherein the outer-ring flow dividing baffles and the inner-ring flow dividing baffles are fixed to the spot cooling device main body by way of spot welding, located corresponding to the cooling holes in the top die of the die, and oriented towards the same center of circle.

4. The tandem water spot cooling device for the top die according to claim 3, wherein the outer-ring flow dividing baffles and the inner-ring flow dividing baffles are made of 304 stainless steel with thickness of 1-2 mm.

5. The tandem water spot cooling device for the top die according to claim 1, wherein the spot cooling device main body is bonded with the lower sealing plate by a high temperature resistant sealant.

6. The tandem water spot cooling device for the top die according to claim 1, wherein the outer-ring circular track and the inner-ring serpentine passage have diameters with a range of 10-16 mm.

* * * * *